US005836023A

United States Patent [19]

Stone Munson

[11] Patent Number: 5,836,023

[45] Date of Patent: Nov. 17, 1998

[54] DECORATIVE TRIM STRIP FOR COMFORTERS, QUILTS, AND THE LIKE

[76] Inventor: Lou Ann Elizabeth Stone Munson, 7015 Leebrad St., Springfield, Va. 22151

[21] Appl. No.: 792,850

[22] Filed: Jan. 23, 1997

[51] Int. Cl.[6] ..... A47G 9/00

[52] U.S. Cl. ..... 5/482; 5/450; 5/491; 5/501; 5/502

[58] Field of Search ..... 5/482, 493, 490, 5/491, 500, 501, 502, 485, 486, 496; 2/60, 269, 69.5, 211, 244, 115; 6/596, 601, 603, 606, 612

[56] References Cited

U.S. PATENT DOCUMENTS

| | | | |
|---|---|---|---|
| D. 319,366 | 8/1991 | Popovich et al. . | |
| D. 339,495 | 9/1993 | Murray . | |
| 708,109 | 9/1902 | Williams | 5/501 |
| 1,347,642 | 7/1920 | McNatt | 5/502 |
| 1,764,764 | 6/1930 | Stewart | 5/485 |
| 2,139,980 | 12/1938 | Simon . | |
| 2,217,819 | 10/1940 | Rook et al. | 5/485 |
| 2,619,658 | 12/1952 | Weinberg . | |
| 3,273,176 | 9/1966 | Millar | 5/486 |
| 4,884,305 | 12/1989 | Blackmon | 5/496 |
| 4,890,347 | 1/1990 | Fuller . | |
| 4,991,245 | 2/1991 | Franco | 5/485 |
| 5,099,530 | 3/1992 | Scott | 5/485 |
| 5,099,531 | 3/1992 | Schmier . | |
| 5,118,553 | 6/1992 | Boisson . | |
| 5,240,758 | 8/1993 | Honigberg . | |
| 5,251,350 | 10/1993 | Bordenave, Sr. et al. . | |

FOREIGN PATENT DOCUMENTS

| | | |
|---|---|---|
| 210360 | 2/1908 | Germany . |
| 314254 | 6/1929 | United Kingdom . |
| 2023419 | 1/1980 | United Kingdom . |
| 2049414 | 12/1980 | United Kingdom . |
| 2142233 | 1/1985 | United Kingdom . |

*Primary Examiner*—Brian K. Green
*Assistant Examiner*—Fredrick Conley
*Attorney, Agent, or Firm*—David A. Testardi

[57] ABSTRACT

A detachable and interchangeable decorative trim strip for comforters, quilts, and the like includes a decorative non-linearly patterned edge. The trim strip is removably fastened to the underside of the comforter and folded over the comforter's edge so that a decorative portion of the trim strip overlies the top side of the comforter. In a bedding arrangement, the comforter has an edge portion which substantially overlies an edge of the top surface of a bed, and the trim strip substantially completely covers the edge portion of the comforter. In an interior design system, the trim strip includes a rod pocket, and the trim strip may either be fastened to the comforter by means of removable fasteners or slipped over a horizontal rod to effect window treatment, wall treatment, or shower enclosure treatment.

21 Claims, 7 Drawing Sheets

FIG. 3A
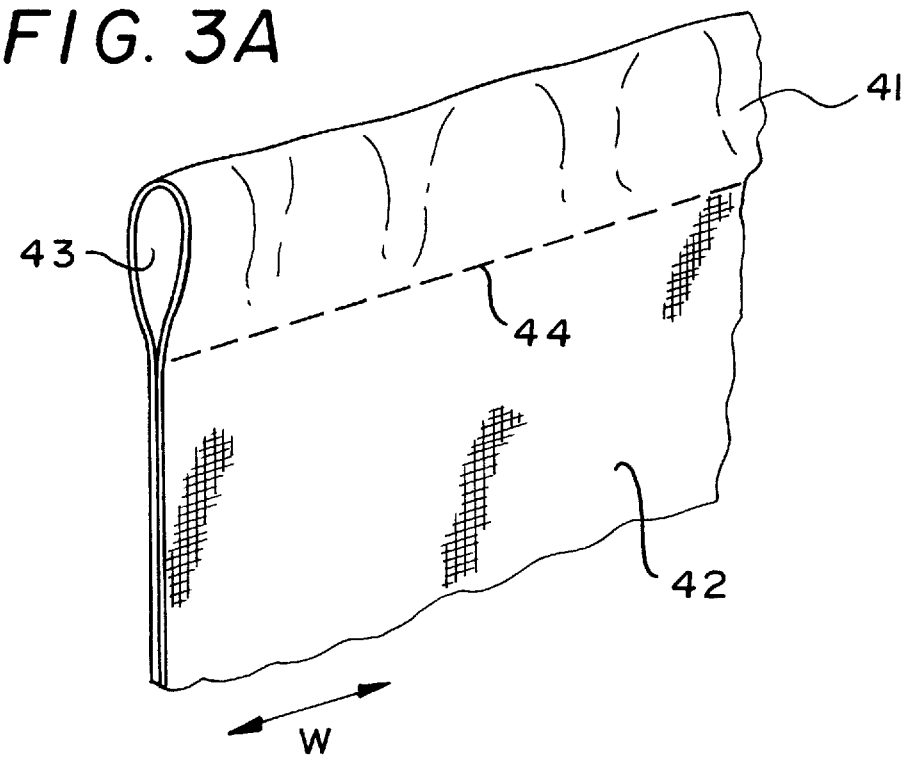
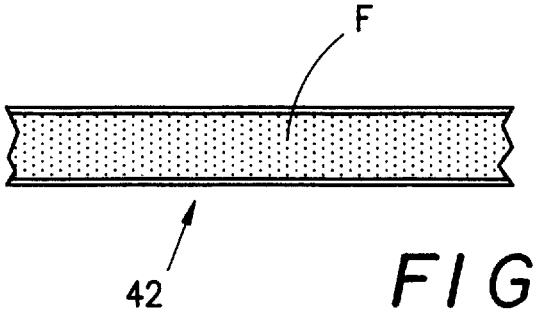
FIG. 3B
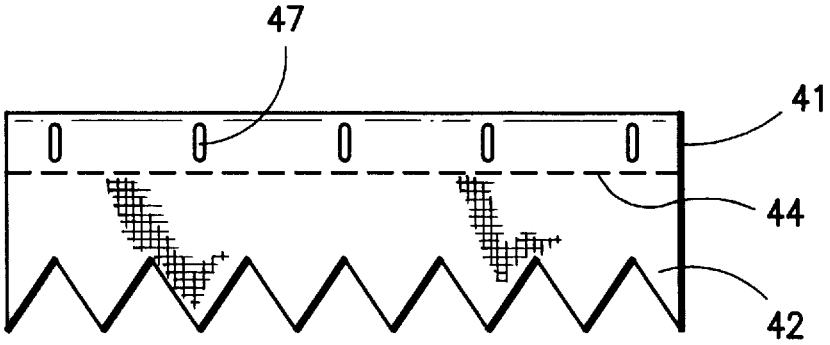
FIG. 4

FIG. 9
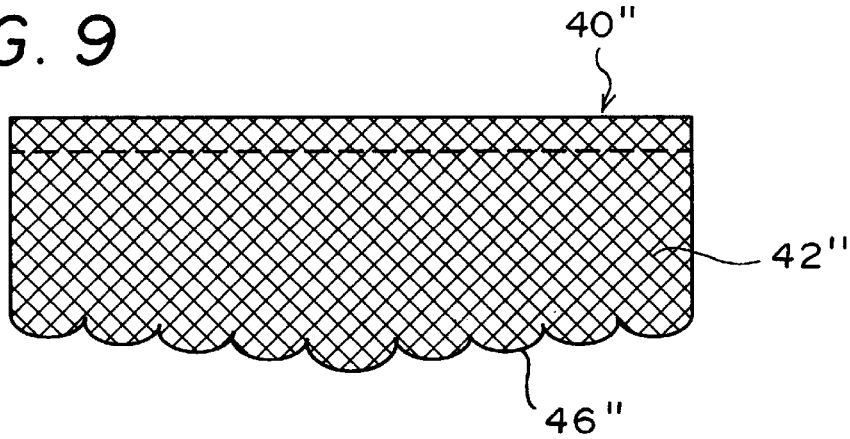
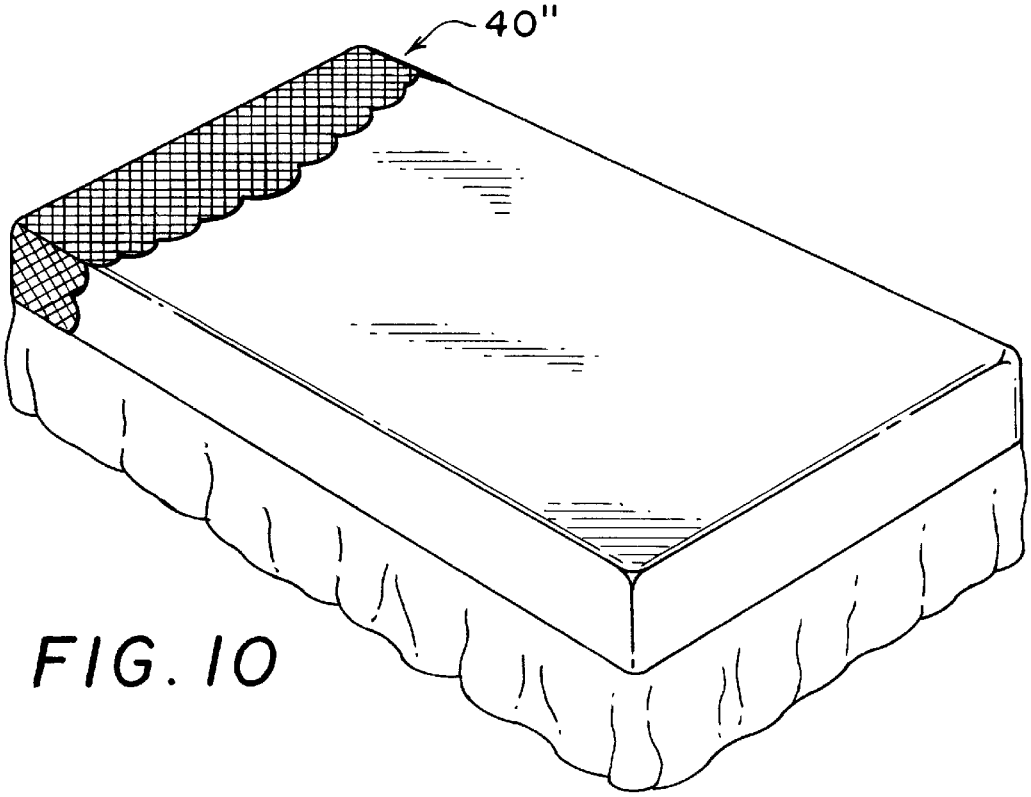
FIG. 10
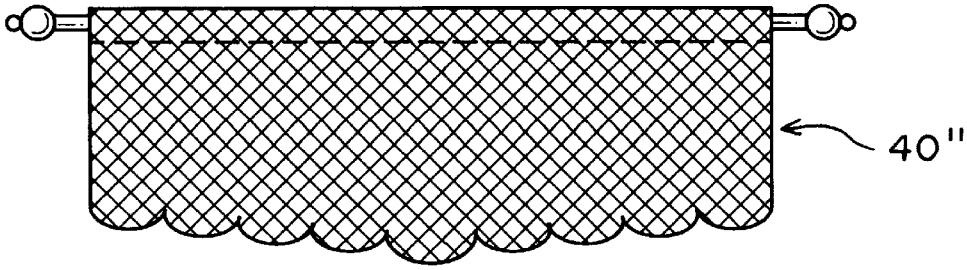
FIG. 11

DECORATIVE TRIM STRIP FOR COMFORTERS, QUILTS, AND THE LIKE

BACKGROUND OF THE INVENTION

1. Field of the Invention

This invention pertains to the field of bedclothes or bed coverings. More particularly, this invention pertains to the field of decorative trim which is particularly suited for use with bedclothes or bed coverings such as comforters and quilts. Still more particularly, this invention pertains to the field of detachable and interchangeable decorative trim strips for comforters and quilts.

2. Description of the Related Art

The prior art reveals a variety of decorative or functional attachments which are suitable for use with beds and the like. For example, U.S. Pat. No. 2,139,980 reveals a detachable valance for a bed. U.S. Pat. No. 2,619,658 reveals an adjustable and removable valance for studio couch or bed. U.S. Pat. No. 3,273,176 reveals a detachable extension flap for a blanket. United Kingdom Patent Application GB 2142233 reveals a quilt having a protective sheet attached thereto by press studs. U.S. Pat. No. 4,890,347 reveals a detachable decorative applique piece which is designed to be fastened to a comforter or bedspread. U.S. Pat. No. Des. 319,366 reveals a sheet for a comforter or blanket. U.S. Pat. No. Des. 339,495 reveals a dust ruffle with VELCRO brand fasteners. U.S. Pat. No. 5,118,553 reveals a bed covering made up of two connectable panels having respective complementary fasteners disposed at their overlapping borders. In the '553 patent, it is suggested that the first panel may be fabricated from a blanket underliner material (such as used for a conventional bed sheet), a "blanket material", a cloth material, or a synthetic material. Moreover, the second panel may be fabricated from a blanket underliner material, a "sheet material", or a material which may be more decorative than the first panel. At least the bottom side of the second panel is desirably imprinted, embroidered, or otherwise decorated. It is also suggested that the first and second panels may have equal widths.

It is an object of the invention to provide a bedclothing arrangement which is user-configurable to provide a high degree of customization at a reasonable cost.

It is another object of the invention to provide a bedclothing arrangement which provides some protection for the end of a comforter, quilt, or other bed covering that is handled the most.

It is still another aspect of the invention to provide a coordinated system of interior design for bedrooms and other living quarters.

SUMMARY OF THE INVENTION

In one respect, the invention relates to a bedclothing arrangement including a bed covering, a decorative trim strip made of flexible decorative material, and fastening means for removably fastening the decorative trim strip to the bed covering. The bed covering comprises a bottom panel adapted to be positioned face down on a bed, a top panel, and filler material disposed between the bottom panel and the top panel. The fastening means comprise complementary fastener structures provided respectively at the bottom panel of the bed covering and on a first portion of the decorative trim strip. In this respect, the decorative trim strip is sized and configured and the fastening means are positioned and arranged in such a manner that, when the decorative trim strip is fastened to the bed covering by the fastening means, a second portion of the decorative trim strip is capable of being extended beyond an edge of the bed covering and manipulated or folded over the edge of the bed covering to thereby overlie a corresponding portion of the top panel of the bed covering.

In another respect, the invention relates to a bedding arrangement including a bed having a top horizontal surface, a bed covering overlying the top surface of the bed, a decorative trim strip made of flexible material, wherein the decorative trim strip has a decorative, non-linearly patterned edge portion which extends in a widthwise direction of the decorative trim strip and overlies the top surface of the bed, and fastening means for removably fastening the decorative trim strip to the bed covering in such a manner that the decorative trim strip substantially covers or substantially completely covers an edge portion of the bed covering and the decorative, non-linearly patterned edge portion of the decorative trim strip overlies a portion of the top surface of the bed.

In still another respect, the invention relates to an interior design system including a bed supported in an interior of a building, a horizontal rod supported in the interior of the building, a bed covering overlying the bed, a decorative trim strip made of flexible material, and fastening means for removably fastening the decorative trim strip to the bed covering. In this respect, the decorative trim strip comprises a rod pocket which is adapted to permit selective positioning of the decorative trim strip over the horizontal rod to effect decorative treatment of the interior of the building.

In yet another respect, the invention relates to a decorative attachment for an article of bedclothing, comprising a decorative trim strip made of flexible material, wherein the decorative trim strip comprises a first portion and a second portion. In this respect, the first portion of the decorative trim strip comprises fastening means, extending in a widthwise direction on the decorative trim strip, for removably fastening the decorative trim strip to the article of bedclothing, and the second portion of the decorative trim strip comprises a decorative, non-linearly patterned edge portion which extends in the widthwise direction of the decorative trim strip.

The invention will, however, be best understood by a review of the following detailed description in conjunction with the accompanying drawings in which:

BRIEF DESCRIPTION OF THE DRAWINGS

FIG. 3A is an enlarged view of the decorative trim strip shown FIG. 1 revealing the rod pocket;

FIG. 3B schematically shows a partial sectional view of the second portion of the decorative trim strip in the case where the second portion of the decorative trim strip is quilted and comprises light filling material disposed between the front and back fabric layers;

FIG. 4 is a back-side view of the decorative trim strip shown in FIG. 1 revealing the buttonholes;

FIGS. 9 to 11 reveal a third embodiment of the invention;

DESCRIPTION OF THE PREFERRED EMBODIMENTS

Figure 1:
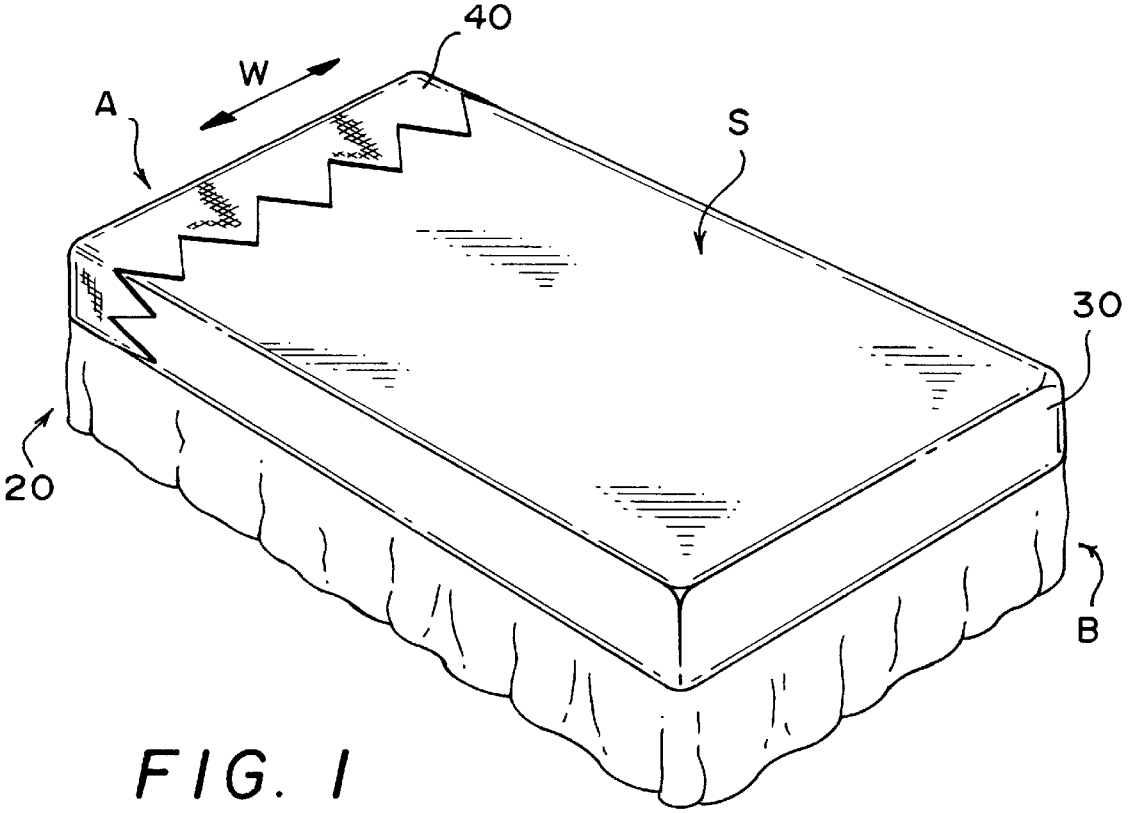
FIG. 1 is a perspective view of a bed having a comforter and decorative trim strip arranged thereon according to a first embodiment of the invention.
Figure 5A:
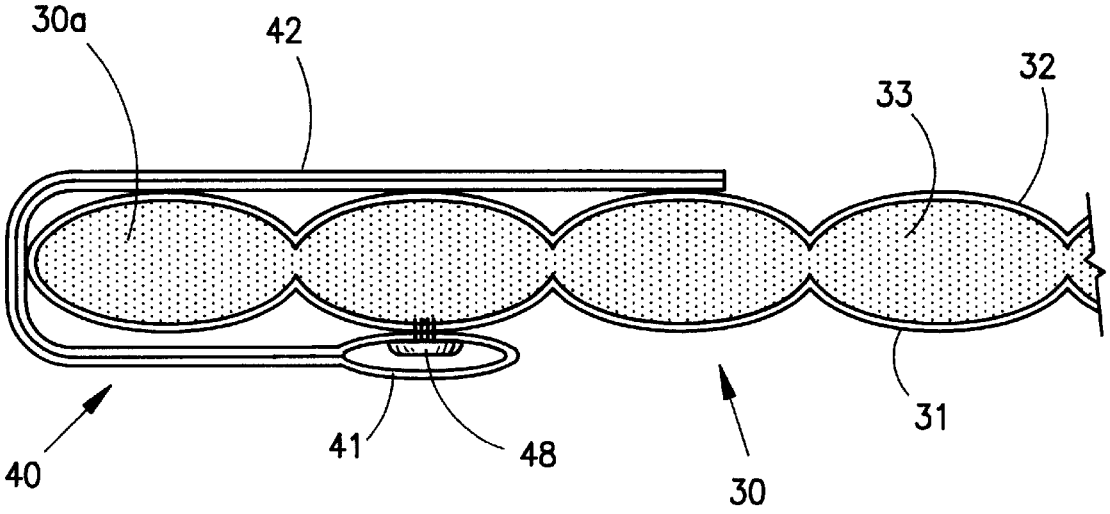
FIG. 5A is a cross-sectional view of the comforter shown in FIG. 1.
Figure 5B:
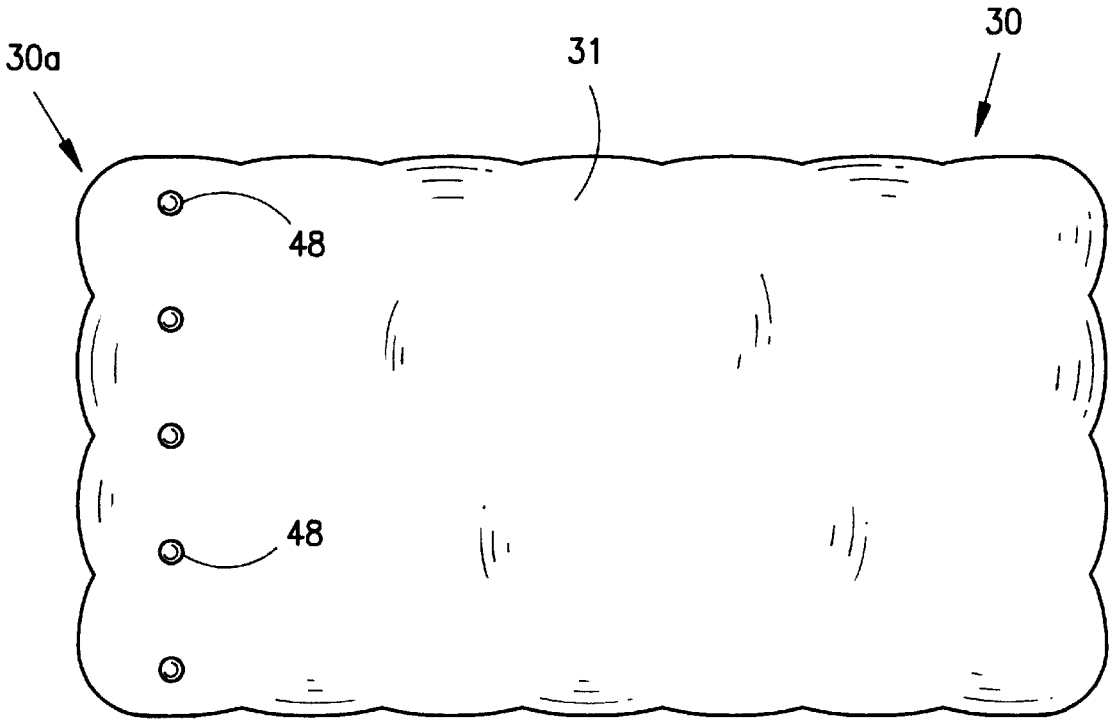
FIG. 5B is a bottom perspective view of the comforter shown in FIG. 1.
Figure 6:
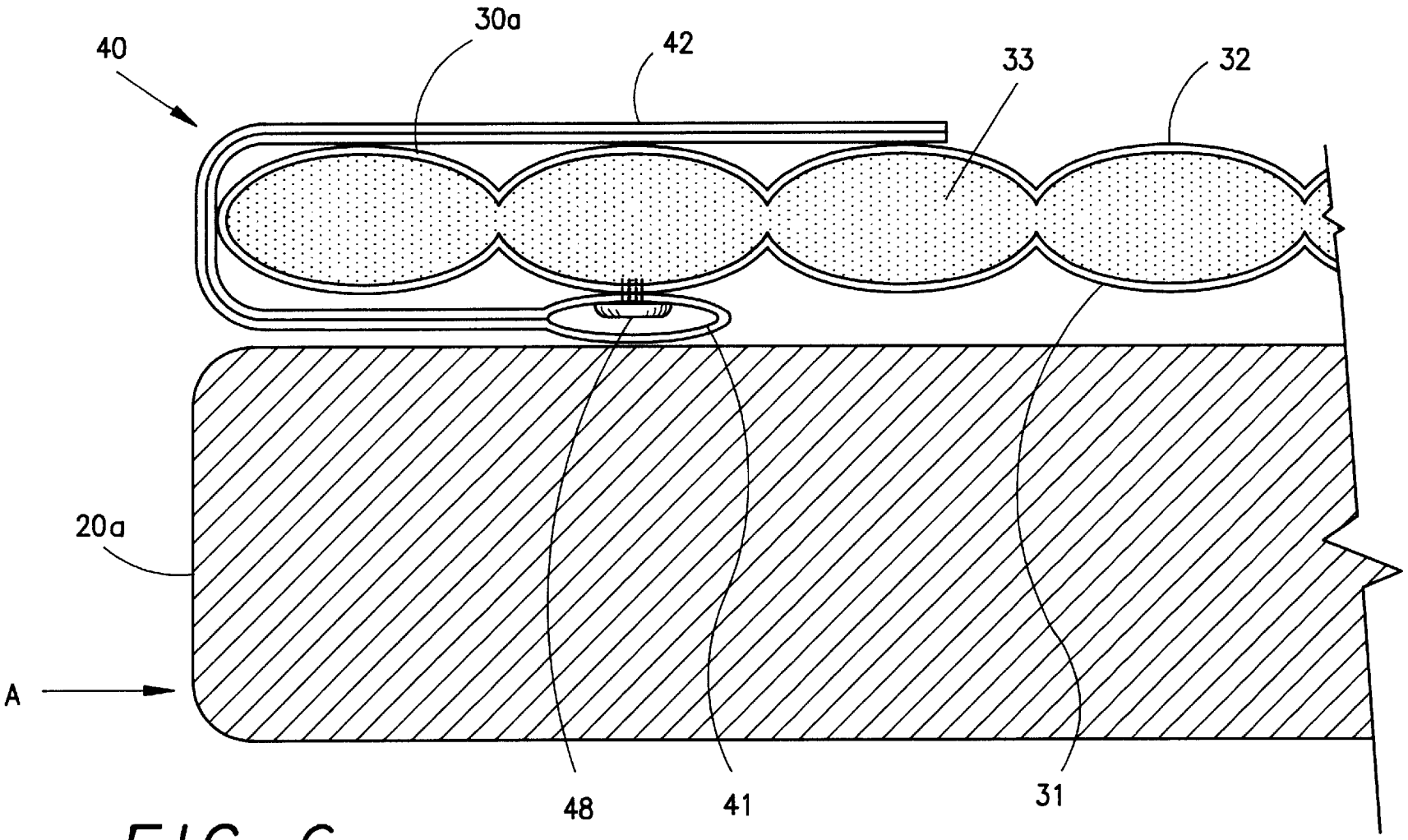
FIG. 6 is a cross-sectional view of the bed, comforter, and decorative trim strip shown in FIG. 1.

Referring now to the drawings in which like reference characters indicate like elements throughout, there is shown in FIGS. 1 to 6 a first preferred embodiment of the invention comprising a standard-sized bed 20 on which a comforter 30 (or other bed covering, such as a quilt) and a decorative trim strip 40 are disposed. The bed 20 in FIG. 1 is, for example, a conventional twin, full, queen, or king-sized bed and comprises a head portion (or pillow end) indicated at A, a foot portion indicated at B, and a top surface indicated at S. The comforter 30 (which may, for example, be a standard-sized comforter having a width and length sized and adapted to fit or cover a twin, full, queen, or king-sized bed) is conventionally positioned so as to overlie the top surface S of the bed 20 and extend partly down the sides and foot of the bed. At the head portion A of the bed 20, the comforter 30 does not extend downwardly beyond the top surface of the bed 20, but (as shown in FIG. 6) a forwardmost edge portion 30*a* of the comforter 30 is positioned so as to generally or substantially overlie the forwardmost edge portion 20*a* of the bed 20. The decorative trim strip 40 is removably fastened to the comforter 30 (in a manner that will be described in detail hereinafter with respect to FIGS. 4 to 6) and is preferably positioned so that the decorative trim strip 40 substantially covers at least that portion 30*a* of the forwardmost edge of the comforter 30 that overlies the top surface S of the bed 20. The decorative trim strip 40 extends in a widthwise direction W across the comforter 30, and is preferably either substantially or generally the same width as or smaller in width than the comforter 30. (By "generally the same width as", it is meant that the width of the decorative trim strip is within approximately six inches of the width of the comforter 30 or other bed covering.) In the preferred embodiments, the width of the decorative trim strip 30 is equal to the width of the comforter 30, and the length (i.e. perpendicular to its width) of the decorative trim strip 40 is less than the full length of the comforter 30. (More particularly, the length of the decorative trim strip 40 is preferably less than approximately one-half the full length of the comforter 30.) In the preferred embodiments, the length is preferably selected such that the decorative trim strip 40 overlies or covers, for example, between approximately 10" and 24" (e.g. 18") of the comforter 30 at the head portion A of the bed 20.

Figure 2:
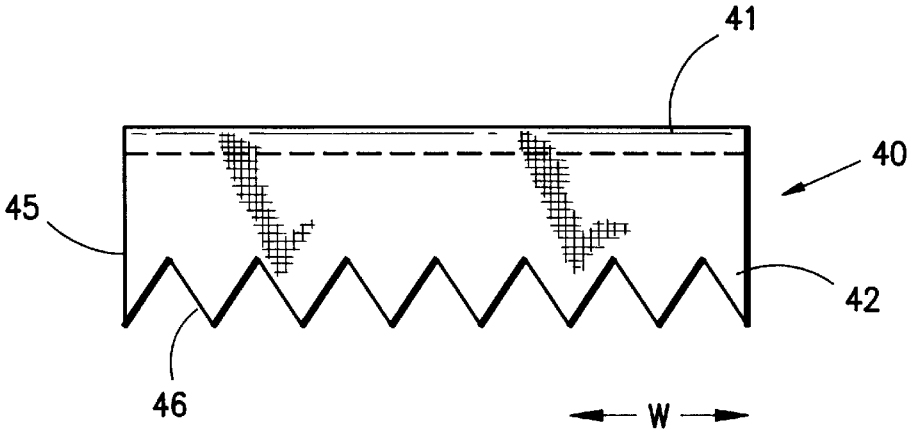
FIG. 2 is a front-side view of the decorative trim strip shown in FIG. 1.

FIGS. 2, 3A, and 3B show the details of the decorative trim strip 40 according to the preferred embodiment of the invention. The decorative trim strip 40 is made from (or comprises) a suitable decorative (e.g. patterned or colored) flexible, readily cleanable fabric (such as cotton or silk sheet material, or lace material) and includes a first portion 41 having primarily functional features and characteristics (e.g. used for fastening or attachment) and a second portion 42 having primarily decorative features and characteristics. As shown in FIG. 3A the first portion 41 includes a fabric loop 43 arranged and configured so as to function as a rod pocket or sleeve. According to the preferred embodiment of the invention, the fabric loop 43 at an end portion of the decorative trim strip 40 (i.e. as shown in the drawing FIGS.) by doubling over the flexible fabric which comprises the decorative trim strip 40 and then stitching the two fabric layers, as at 44, to form the base of the loop. The fabric loop, thus made from the two fabric layers, at the folded portion of the flexible fabric (i.e. as shown in the drawing FIGS.) extends the entire width (as indicated at W) of the first portion 41 of the decorative trim strip 40. The second (or decorative) portion 42 of the decorative trim strip 40 is preferably comprised of that portion or those portions of the two fabric layers which extend(s) below (e.g. as depicted in FIGS. 2 and 3) the stitching line 44. While it is presently preferred to extend both layers of fabric below the stitching line 44 to make the second portion 42, it is also envisioned that the second portion may be fabricated as an extension panel of only one of the fabric layers. In the case where two fabric layers are employed to form the second portion 42, it is preferred that the edges 45, 46 of the fabric layers which comprise the second portion 42 of the decorative trim strip 40 be sewn together. In the case where a light filling of batting material F is additionally disposed between the two fabric layers below the stitching line 44, then the fabric layers which comprise the second portion 42 of the decorative trim strip 40 are also sewn or fastened together at other locations (i.e. at several positions disposed inwardly from the edges) to provide second portion 42 of the decorative trim strip 40 with a quilted characteristic.

Referring again to FIG. 2, the second portion 42 of the decorative trim strip 40 includes side edges 45 and a decorative edge 46 that extends in the widthwise direction, as indicated at W. The side edges 45 are generally linear (that is, they each extend in the direction of a single straight line), while the decorative edge 46 is, in the preferred embodiment of FIG. 2, non-linearly cut or patterned (that is, the edge portion of the fabric which constitutes the decorative trim strip is formed by cutting, sewing, etc. in such a manner that, when the fabric is laid flat in an extended, unpleated manner, the edge 46 does not extend in the direction of a single straight line). In particular, the decorative edge 46 is cut or extends in a zig-zag fashion, having alternating peak and valleys.

The manner by which the decorative trim strip 40 is removably attached to the comforter will now be explained with respect to FIGS. 4 to 6.

As shown in FIG. 4, the back side of the first portion 41 of the decorative trim strip 40 is provided with a plurality of (e.g. five) buttonholes 47, arranged, for example, in a single, uniformly spaced row that extends in the widthwise direction of the decorative trim strip 40. The buttonholes preferably extend through only one layer (i.e. the back layer) of the fabric loop 43. Accordingly, when buttons are inserted into the buttonholes 47, they remain hidden and cannot be seen from the front (or back) of the decorative trim strip 40. According to the preferred embodiment of FIG. 4, the actual holes or openings which comprise the buttonholes are all configured so that each hole or opening preferably extends in the vertical direction (i.e. perpendicularly to the widthwise direction W of the decorative trim strip 40), and the row of buttonholes is arranged relatively closely adjacent to the edge of the first portion 41 of the decorative trim strip 40.

As shown in FIGS. 5A and 5B, the comforter 30 (or other bed covering such as a quilt) includes a bottom panel 31 adapted to be positioned face down on the bed 20, a top panel 32, and filler material 33 (such as fibrous material, down and feathers, or the like) disposed between the bottom panel 31 and the top panel 32. Adjacent the forwardmost edge portion 30*a* of the comforter 30 (e.g. within about 2" to about 6" of the forwardmost edge 30*a*), a series of (e.g. five) buttons 48 are attached to (or otherwise provided on) the bottom panel 31 of the comforter 30. As shown in FIG. 5B, the buttons are spaced and arranged (e.g. in a single, uniformly spaced row that extends in the widthwise direction of the comforter 30) so as to be cooperable with the buttonholes 47 provided on the decorative trim strip 40 to thereby removably fasten the decorative trim strip 40 to the comforter 30 (or more particularly, to the bottom panel 31 of the comforter 30). The buttonholes 47 and buttons 48 thus constitute complementary fastener structures.

FIG. 6 reveals the manner in which the decorative trim strip 40 is removably fastened to the comforter (or other bed covering) 30 according to the preferred embodiment of the invention. In particular, the buttons 48 on decorative trim strip 40 are inserted into the buttonholes provided in the first portion 41 of the decorative trim strip. This secures the decorative trim strip to the bottom panel 31 of the comforter 30. Next, the second portion 42 of the decorative trim strip 40 (e.g. which is the decorative portion) is extended beyond the forwardmost edge portion 30*a* of the comforter 30 and then folded (or manipulated) over the forwardmost edge portion 30*a* of the comforter 30 so as to thereby overlie a portion of the top panel 32 of the comforter with the decorative shape, fabric pattern, or color of the decorative trim strip 40 exposed. It is noted that the length and configuration of the decorative trim strip 40 as well as the position and arrangement of the buttonholes and buttons 47, 48 are all selected to ensure that the decorative edge 46 of the decorative trim strip 40 will be positioned at a suitable location over the top panel 32 of the comforter 30 after the second portion 42 of the decorative trim strip 40 is extended and manipulated. In this manner, the decorative trim strip 40 substantially completely covers the forwardmost edge portion 30*a* of the comforter 30 and also overlies a portion of the top surface S of the bed 20. Consequently, in addition to being aesthetically pleasing, the decorative trim strip 40 also provides some protection for the end of a comforter, quilt, or other bed covering that is handled the most.

Figure 7:
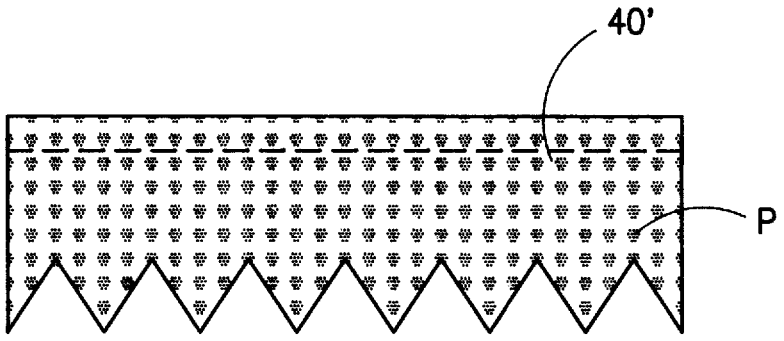
FIG. 7 is an alternative embodiment for the decorative trim strip shown in FIG. 1.
Figure 8:
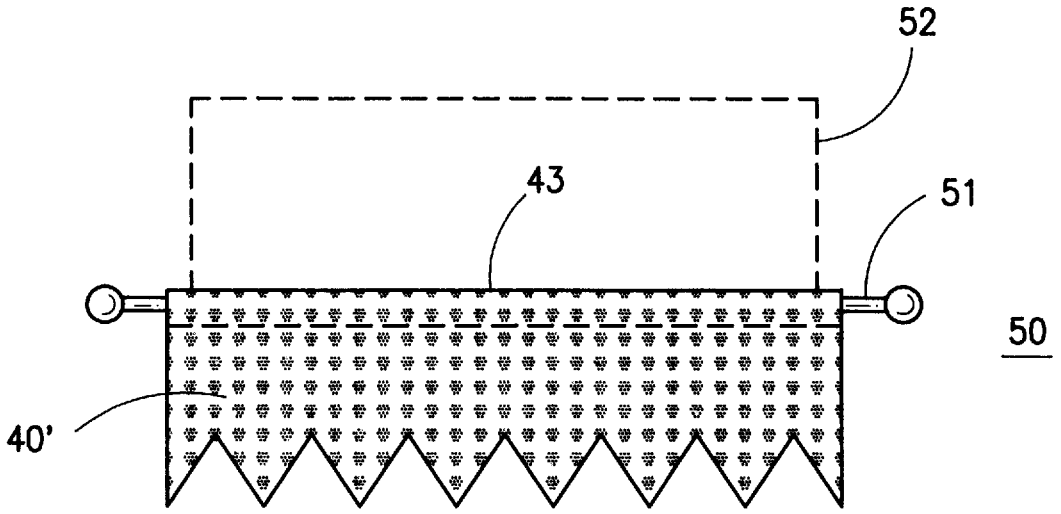
FIG. 8 reveals the decorative trim strip of FIG. 7 used as window treatment.

FIGS. 7 and 8 reveal an alternate preferred embodiment of the invention in which a decorative trim strip 40' is provided with decorative patterns P to enhance its decorativeness and versatility. (In all other respects, this embodiment of the invention is identical to the first embodiment of the invention described in connection with FIGS. 1 to 6.) The decorative patterns P may be printed, embroidered, sewn on as a panel, or formed as patchwork from a combination of different materials or fabrics. In one alternate preferred embodiment of the invention, the decorative patterns P are applies to only one side (e.g. the front side) of the decorative trim strip 40'. In another alternate preferred embodiment of the invention, different decorative patterns P are provided on each side of the decorative trim strip 40'.

In FIG. 8, the versatility of the decorative trim strips 40' (or 40) is exemplified. Specifically, the decorative trim strip 40' (or 40) has been positioned over a drapery rod 51 or the like provided adjacent a window 52 in a bedroom 50 having a bed 20 (FIG. 1) or the like disposed therein by first opening the fabric loop 43' (which now functions as a rod pocket) and thereafter feeding the drapery rod 51 through the fabric loop 43'. In this manner, the decorative trim strip 40' (or 40) may be employed as the central element of a coordinated interior design system in which selective positioning of the decorative trim strip 40' (or 40) over a horizontal rod selectively effects decorative suspension type treatment (such as window, wall, or shower enclosure treatment) for the interior of a building such as a dwelling.

FIGS. 9 to 11 reveal yet another preferred embodiment of the invention. The embodiment is, in all respects, identical to the embodiments described in conjunction with FIGS. 1 to 6 and FIGS. 7 and 8, except that the decorative edge 46" of the second or decorative portion 42" of the decorative trim strip 40" has a scalloped profile.

Figure 12:
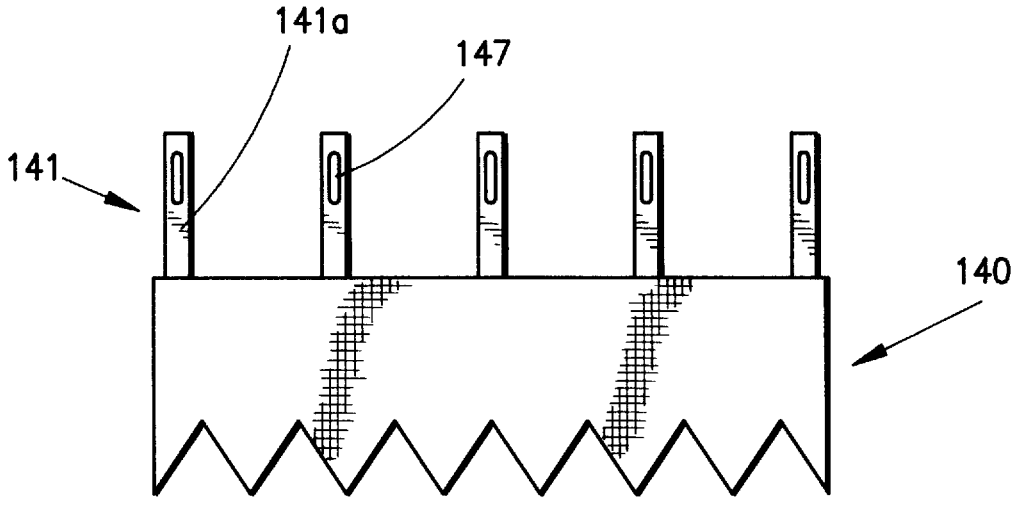
FIG. 12 reveals another alternative embodiment of the decorative trim strip shown in FIG. 1.
Figure 13:
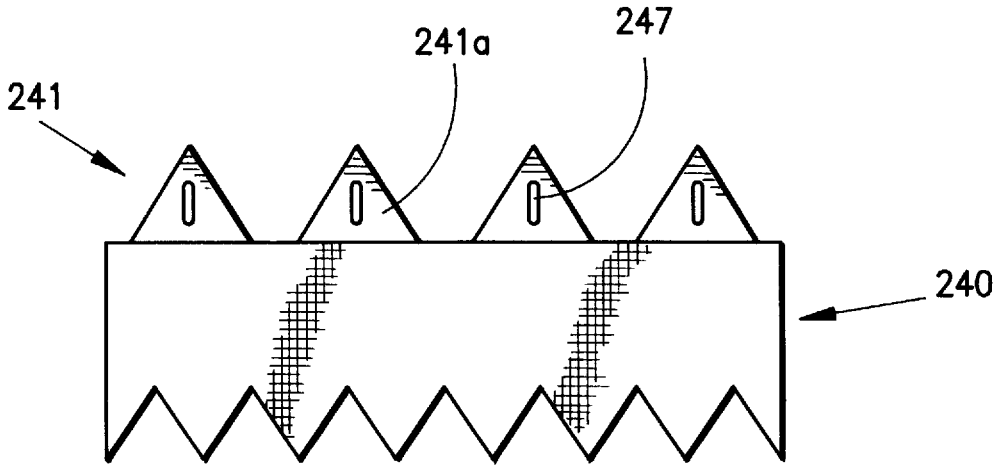
FIG. 13 reveals still another alternative embodiment of the decorative trim strip shown in FIG. 1.

FIGS. 12 and 13 reveal reversible decorative trim strips 140 and 240 according to yet other preferred embodiments of the invention in which the first portions 141, 241 of the trim strips comprise a plurality of rectangular or triangular individual fastening strips 141*a*, 241*a* having buttonholes 147, 247 disposed therein. The buttonholes 147, 247, in the first portions 141, 241 are adapted to receive the buttons 48 provided on the comforter 30 (or other bed covering) shown in FIGS. 5A and 5B, and the decorative trim strips 140, 240 are adapted to be attached to the comforter (or other bed covering) in the same manner described with respect to FIG. 6. Moreover, since the buttonholes 147, 247 extend through the individual fastening strips 141*a*, 142*a*, the decorative trim strips 140, 240 are effectively reversible and may be provided with different or distinct decorative patterns (e.g. by means of imprinting or embroidery) or fabric panels on their respective front-sides and back-sides (e.g. as shown and described in conjunction with FIG. 7). In this case, however, the decorative trim strips 141, 241 do not include the decorative window, wall, or shower enclosure treatment features of the other embodiments.

In the appended claims, the term "strip" shall cover any piece or body of material or materials whose length is small relative to (e.g. smaller than) its width.

While the preferred embodiments of the invention have been described with certain particularity, various modifications will be envisioned by those skilled in the art. For example, other separable fastener structures (such as, for example, snaps, hook and loop type fasteners, or zippers) may be employed to replace the disclosed button and buttonhole arrangement, and the complementary fastener structures may be formed integrally with or by the comforter or decorative trim strip. The comforter and decorative trim strip may be used together with matching pillow shams and dust ruffles to provide a new custom look to an entire room. The second portion of the decorative trim strip may be pleated in a manner similar to conventional window treatment. The decorative edge of the decorative trim strip may be covered with or formed from a lace material, or it may have decorative pointed features or castellations, or random or patterned curves or angles. Tassels, decorative ribbon, bows, or beads may be affixed to or form a part of the decorative edge. The width of the trim strip may be selected to be less than or substantially equal to a standard width of a standard comforter (e.g. for a twin, full, queen, or king-sized bed) or any other bed covering for which the decorative trim strip is intended to be used with, or the width of the trim strip may be up to approximately 6" greater than the width of the bed covering. The length of the second portion of the decorative trim strip (i.e. perpendicular to the width) may be selected so as to produce the most aesthetically pleasing design, and the length of the entire trim strip (including the first portion) may be, for example, between about 10" to about 40". A plurality of different decorative trim strips may be selectively coordinated with a single comforter or quilt, and a plurality of similar or different decorative trim strips may be packaged and sold with a single comforter or quilt with or without bedsheets and pillow shams so as to provide decorative treatment alternatives for a bed, room, or building. Therefore, the present invention shall encompass the preferred embodiments described herein as well as any modifications or equivalents thereof which will fall within the scope of the appended claims.

I claim:

1. A bedclothing arrangement, comprising:

a bed covering sized to cover a standard-sized bed, the bed covering having a length, adapted to extend from a head portion to a foot portion of the bed, and a width;

a decorative trim strip made with flexible fabric, the decorative trim strip having a width and a length, wherein the width of the trim strip is greater than the length of the trim strip, and the length of the trim strip is less than the length of the bed covering; and fastening means for removably fastening the decorative trim strip to the bed covering in such a manner that the width of the decorative trim strip extends in a widthwise direction across the width of the bed covering;

wherein the bed covering comprises a bottom panel adapted to be positioned face down on a bed, a top panel, and filler material disposed between the bottom panel and the top panel, wherein the fastening means comprise complementary fastener structures provided respectively at the bottom panel of the bed covering and on a first portion of the decorative trim strip, wherein the decorative trim strip is sized and configured and the fastening means are positioned and arranged in such a manner that, when the decorative trim strip is fastened to the bed covering by the fastening means, a second portion of the decorative trim strip is capable of being extended beyond an edge of the bed covering and manipulated over the edge of the bed covering to thereby overlie a corresponding portion of the top panel of the bed covering, wherein the second portion of the decorative trim strip comprises a decorative, non-linearly patterned edge portion which extends in a widthwise direction of the decorative trim strip, wherein the flexible fabric which comprises the decorative trim strip is doubled over at the first portion of the decorative trim strip so as to loop back upon itself and thereby define front and back fabric layers, the front and back fabric layers being stitched together along a stitching line which extends in the widthwise direction of the decorative trim strip, the stitching line forming a base of the first portion of the decorative trim strip, and wherein the second portion of the decorative trim strip is comprised of a portion the front fabric layer which extends from below the stitching line to the non-linearly patterned edge portion and a portion of the back fabric layer which extends from below the stitching line to the non-linearly patterned edge portion.

2. The bedclothing arrangement as recited in claim 1, wherein batting material is disposed in the second portion of the decorative trim strip between the front and back fabric layers.

3. The bedclothing arrangement as recited in claim 1, wherein the flexible fabric of the decorative trim strip is doubled over at a folded portion of the flexible fabric, the folded portion being disposed in the first portion of the decorative trim strip, and wherein the front and back fabric layers extend together from the folded portion to the non-linearly patterned edge portion.

4. A bedclothing arrangement, comprising:

a bed covering sized to cover a standard-sized bed, the bed covering having a length, adapted to extend from a head portion to a foot portion of the bed, and a width;

a decorative trim strip made with flexible material, the decorative trim strip having a width and a length, wherein the width of the trim strip is greater than the length of the trim strip, and the length of the trim strip is less than the length of the bed covering; and fastening means for removably fastening the decorative trim strip to the bed covering in such a manner that the width of the decorative trim strip extends in a widthwise direction across the width of the bed covering;

wherein the bed covering comprises a bottom panel adapted to be positioned face down on a bed, a top panel, and filler material disposed between the bottom panel and the top panel, wherein the fastening means comprise complementary fastener structures provided respectively at the bottom panel of the bed covering and on a first portion of the decorative trim strip, wherein the decorative trim strip is sized and configured and the fastening means are positioned and arranged in such a manner that, when the decorative trim strip is fastened to the bed covering by the fastening means, a second portion of the decorative trim strip is capable of being extended beyond an edge of the bed covering and manipulated over the edge of the bed covering to thereby overlie a corresponding portion of the top panel of the bed covering, wherein the complementary fastener structures provided respectively at the bottom panel of the bed covering and on the first portion of the decorative trim strip comprise buttons and buttonholes, respectively, wherein the decorative trim strip includes a sleeve having two overlying material layers that extend in a widthwise direction of the decorative trim strip, and wherein the buttonholes are formed through only a single one of the two overlying material layers, and wherein the two overlying material layers extend together to the second portion of the decorative trim strip.

5. The bedclothing arrangement as recited in claim 4, wherein the sleeve is a rod pocket which extends substantially an entire width of the first portion of the decorative trim strip.

6. The bedclothing arrangement as recited in claim 4, wherein the flexible material of the decorative trim strip is doubled over at a folded portion of the flexible fabric, wherein the sleeve includes the folded portion.

7. The bedclothing arrangement as recited in claim 4, wherein the sleeve extends the entire width of the first portion of the decorative trim strip, and wherein the sleeve can be opened for receiving a suspension rod therein.

8. A bedding arrangement comprising:

a bed having a top surface;

a bed covering overlying the top surface of the bed, the bed covering having an edge portion; wherein the bed covering comprises a bottom panel positioned face down on the bed, a top panel, and filler material disposed between the bottom panel and the top panel;

a decorative trim strip made with flexible fabric, wherein the flexible fabric of the decorative trim strip is folded over at a folded portion so as to define front and back fabric layers which are stitched together along a stitching line that extends in a widthwise direction of the decorative trim strip, wherein the front and back fabric layers together extend from the folded portion to a decorative, non-linearly patterned edge portion of the decorative trim strip which extends in the widthwise direction of the decorative trim strip and overlies the top surface of the bed; and fastening means for removably fastening the decorative trim strip to the bottom panel of the bed covering in such a manner that:

the decorative trim strip substantially covers the edge portion of the bed covering; and the decorative, non-linearly patterned edge portion of the decorative trim strip overlies a portion of the top surface of the bed, wherein the fastening means comprises a series of spaced apart buttons attached to the bottom panel of the comforter, the buttons being spaced and arranged to be cooperable with buttonholes provided in the decorative trim strip.

9. The bedding arrangement as recited in claim 8, wherein the bed covering is a comforter.

10. The bedding arrangement as recited in claim 8, wherein the decorative trim strip is folded around the edge portion of the bed covering.

11. The bedding arrangement as recited in claim 8, wherein the edge portion of the bed covering substantially overlies an edge of the top surface of the bed.

12. The bedding arrangement as recited in claim 8, wherein batting material is disposed in the second portion of the decorative trim strip between the front and back fabric layers.

13. The bedding arrangement as recited in claim 8, wherein the front and back fabric layers extend together from the folded portion to the non-linearly patterned edge portion.

14. A bedclothing arrangement, comprising:

a comforter;

a decorative trim strip made with flexible fabric material, wherein the decorative trim strip comprises a first portion having primarily functional features and characteristics, and an extendable second portion having primarily decorative features and characteristics, and wherein:

the first portion of the decorative trim strip comprises fastening means, extending in a widthwise direction on the decorative trim strip, for removably fastening the decorative trim strip to the comforter, the second portion of the decorative trim strip comprises a decorative, non-linearly patterned edge portion which extends in the widthwise direction of the decorative trim strip, wherein the flexible fabric material which comprises the decorative trim strip is doubled over at the first portion of the decorative trim strip so as to turn back upon itself and thereby define front and back fabric layers, the thus defined front and back fabric layers also being stitched together along a stitching line which extends in the widthwise direction of the decorative trim strip, the stitching line forming a base of the first portion of the decorative trim strip, and wherein the second portion of the decorative trim strip is comprised of a portion of the front fabric layer which extends from below the stitching line to the non-linearly patterned edge portion and a portion of the back fabric layer which extends from below the stitching line to the non-linearly patterned edge portion.

15. The decorative attachment as recited in claim 14, wherein batting material is disposed in the second portion of the decorative trim strip between the front and back fabric layers.

16. The bedclothing arrangement as recited in claim 14, wherein the flexible fabric material of the decorative trim strip is doubled over at a folded portion of the flexible fabric material, the folded portion being disposed in the first portion of the decorative trim strip and defining the front and back fabric layers, and wherein the front and back fabric layers extend together from the folded portion to the non-linearly patterned edge portion.

17. The bedclothing arrangement as recited in claim 16, wherein a fabric loop is formed in the first portion of the decorative trim strip between the folded portion and the stitching line, and wherein the fabric loop can be opened for receiving a suspension rod therein.

18. The bedding arrangement as recited in claim 14, wherein the comforter has a first side and a second side, and wherein the decorative trim strip is sized and configured and the fastening means are positioned and arranged in such a manner that, when the decorative trim strip is fastened to the first side of the comforter by the fastening means, the second portion of the decorative trim strip is capable of being extended beyond an edge of the comforter and manipulated around the edge to thereby overlie the second side of the comforter.

19. A bedclothing arrangement, comprising:

a comforter;

a decorative trim strip made with flexible material, wherein the decorative trim strip comprises a first portion and a second portion, with the second portion of the decorative trim strip being disposed below the first portion of the decorative trim strip, and wherein:

the first portion of the decorative trim strip comprises fastening means, extending in a widthwise direction on the decorative trim strip, for removably fastening the decorative trim strip to the comforter, and the second portion of the decorative trim strip comprises a decorative, non-linearly patterned edge portion which extends in the widthwise direction of the decorative trim strip, wherein the first portion of the decorative trim strip comprises a fabric loop, wherein the fastening means comprise a series of spaced-apart buttonholes formed in the fabric loop which are adapted to cooperate with series of buttons provided on the comforter, and wherein the fabric loop is disposed at an end portion of the decorative trim strip and comprises two overlying material layers that extend in the widthwise direction of the decorative trim strip, and the buttonholes are formed through only a single one of the two overlying material layers, and wherein the two overlying material layers extend together from below the fabric loop to the decorative, non-linearly patterned edge portion of the decorative trim strip.

20. The bedclothing arrangement as recited in claim 19, wherein batting material is disposed in the second portion of the decorative trim strip between the two overlying material layers.

21. The bedclothing arrangement as recited in claim 19, wherein the fabric loop extends the entire width of the first portion of the decorative trim strip, and wherein the fabric loop can be opened for receiving a suspension rod therein.

* * * * *

UNITED STATES PATENT AND TRADEMARK OFFICE

CERTIFICATE OF CORRECTION

PATENT NO. : 5,836,023

DATED : Nov. 17, 1998

INVENTOR(S) : Stone Munson

It is certified that error appears in the above-indentified patent and that said Letters Patent is hereby corrected as shown below:

On the Cover Page, in Item [56] under "References Cited", please insert the following documents:

--

U.S. PATENT DOCUMENTS

| | | |
|---|---|---|
| 2,262,436 | 11/41 | Cotton . |
| 1,687,580 | 10/28 | Melcer . |

FOREIGN PATENT DOCUMENTS

| | | |
|---|---|---|
| 857870 | 1/61 | United Kingdom . |

-- at column 4, line 2, after "fabric loop 43", please insert --is formed--.

Signed and Sealed this

Eighteenth Day of July, 2000

*Attest:*

Q. TODD DICKINSON

*Attesting Officer*

*Director of Patents and Trademarks*